US007794303B2

(12) United States Patent
Cassidy

(10) Patent No.: US 7,794,303 B2
(45) Date of Patent: Sep. 14, 2010

(54) TOY

(75) Inventor: Paul M. Cassidy, Blackpool (GB)

(73) Assignee: Cassidy Brothers PLC, Blackpool (GB)

( * ) Notice: Subject to any disclaimer, the term of this patent is extended or adjusted under 35 U.S.C. 154(b) by 0 days.

(21) Appl. No.: 12/424,764

(22) Filed: Apr. 16, 2009

(65) Prior Publication Data

US 2009/0325459 A1 Dec. 31, 2009

(30) Foreign Application Priority Data

Jun. 26, 2008 (GB) ..... 0811736.8

(51) Int. Cl.
*A63H 17/00* (2006.01)
*A63H 29/22* (2006.01)
*A63H 30/04* (2006.01)

(52) U.S. Cl. ..... 446/465; 446/460; 446/468; 446/409

(58) Field of Classification Search ..... 446/7, 446/175, 297, 404, 409, 454, 460, 465, 468; 434/29, 62, 262; 463/37, 40; 180/6.5, 22, 180/167, 169
See application file for complete search history.

(56) References Cited

U.S. PATENT DOCUMENTS 4,531,751 A * 7/1985 Todokoro ..... 280/828
4,932,913 A * 6/1990 Raviv et al. ..... 446/7
5,106,102 A 4/1992 Mitsumoto
6,663,393 B1 * 12/2003 Ghaly ..... 434/262
6,771,034 B2 * 8/2004 Reile et al. ..... 318/139
6,915,871 B2 * 7/2005 Gavish et al. ..... 180/167
7,243,053 B1 * 7/2007 Small ..... 703/2
7,243,746 B1 * 7/2007 Vasant ..... 180/6.5
7,344,430 B2 * 3/2008 Hasty et al. ..... 446/456
7,607,962 B2 * 10/2009 Hardin ..... 446/484
2003/0087699 A1 5/2003 Brumagin et al.
2007/0144799 A1 * 6/2007 Vasant ..... 180/65.1

FOREIGN PATENT DOCUMENTS

DE 4444552 6/1996
DE 102006041935 3/2008

* cited by examiner

*Primary Examiner*—Nini Legesse
(74) *Attorney, Agent, or Firm*—Stites & Harbison PLLC; Douglas E. Jackson

(57) ABSTRACT

A navigation apparatus for use with a toy having a movable steering mechanism includes an indicating mechanism for indicating to a user to move the steering mechanism in a first direction. A first sensor is then capable of detecting a movement of the steering mechanism and of outputting first information indicative of the detected direction of motion of the steering mechanism. An alert mechanism is then used for alerting the user on the basis of the first information when (i) the direction of motion of the steering mechanism does not correspond to the indicated direction of motion, and/or (ii) the direction of motion of the steering mechanism corresponds to the indicated direction of motion.

18 Claims, 5 Drawing Sheets

FIG 1
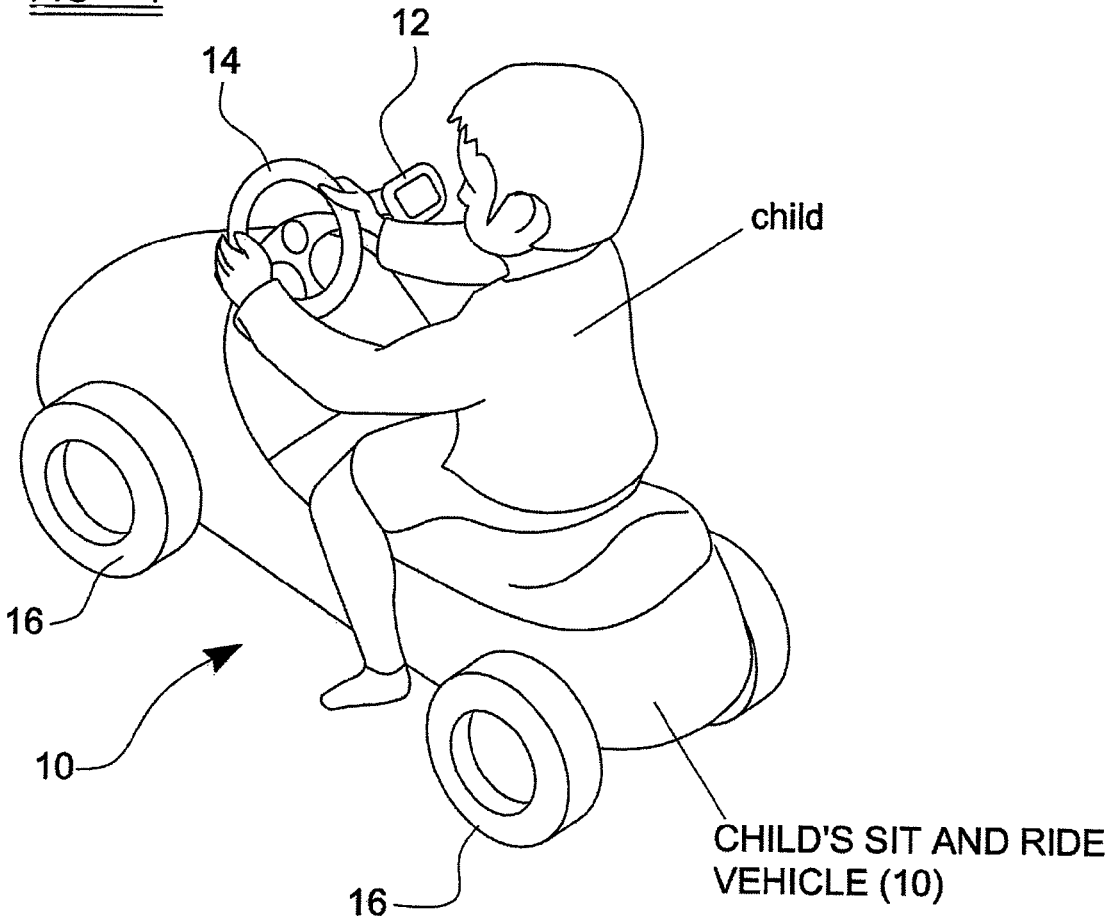
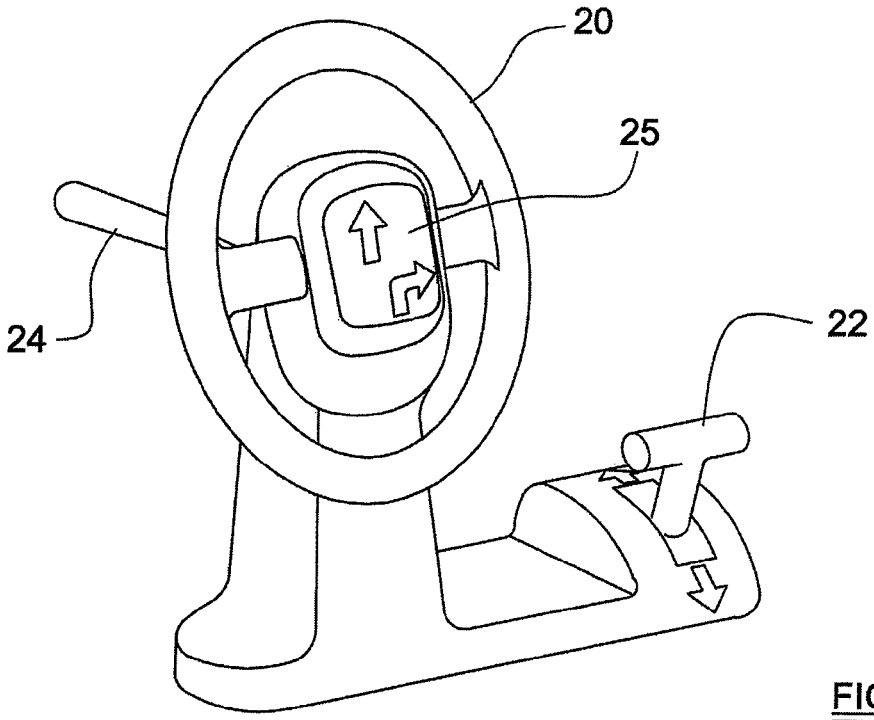
FIG 2

FIG 3a
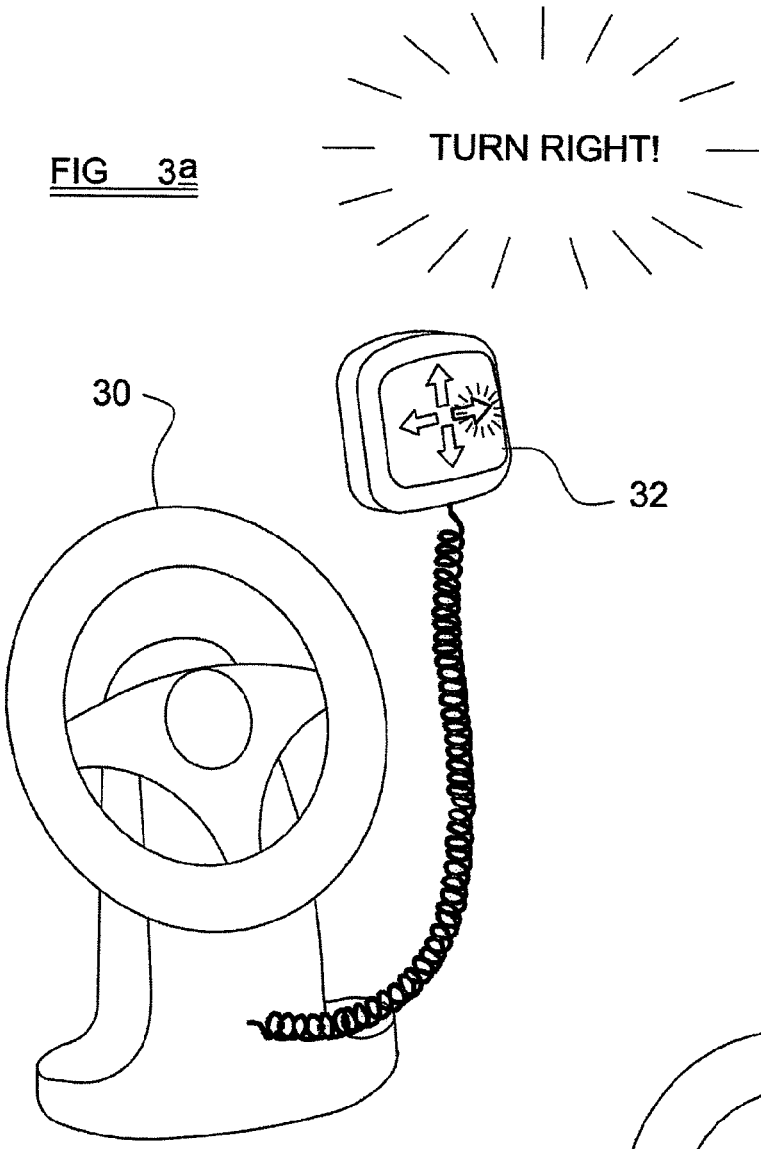
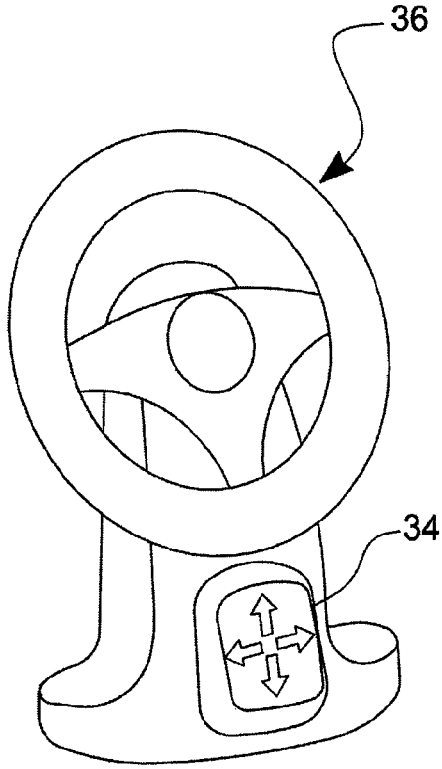
FIG 3b

TOY

The present invention relates to a navigation apparatus, e.g. a toy navigation apparatus, such as a toy satellite navigation (Sat-Nav) apparatus, e.g. for use by a child, together with a toy having a movable steering means.

Sat-Nav systems are becoming ever more popular, particularly Sat-Nav systems which give voice commands to an (adult) driver of a vehicle. There are several types and brands available.

Such Sat-Nav systems have a finite usable "resolution", i.e. an accuracy beyond which it is not able to inform the user as to his or her location. Such accuracy is generally no more than 1 m or so. This is generally considered adequate for the driver of a vehicle when navigating in a city or a motorway, for example.

Children who want to mimic their parents by using a Sat-Nav system may not be permitted to use a parent's (relatively expensive) Sat-Nav system when playing on his or her bike, for example.

Indeed, it is unlikely that a young child would be able to use such a Sat-Nav system in some circumstances. For instance, children who use a real Sat-Nav system in a backyard environment may find, for example, that the resolution of the Sat-Nav is not sufficiently good for them to be able to take advantage of it, the back yard may only be of the order of a few metres wide and several metres long for example, meaning that the resolution of a real Sat-Nav system is inadequate to give useful instructions.

There is available on the market a children's toy which comprises a portion of a replica dashboard having a movable steering wheel, for example, and in some cases a movable gear stick. (An example of such a toy is provided by the "Backseat Driver" and the "Electronic Backseat Driver" as sold by the present applicant.) Such a toy is often mountable in the back of a vehicle such as a car, so that when the child is in transit he or she can play with the steering wheel etc. In such circumstances, a child can listen to the voice commands coming from a real Sat-Nav system, intended to direct the driver to navigate the vehicle appropriately, but ultimately even though the child may respond correctly to the instructions, he or she has no perception of this.

It is an aim of the present invention to overcome at least some of these problems.

Accordingly, the present invention provides a (toy) navigation apparatus according to the following detailed description.

According to the present invention, when a (child) user moves the steering means in accordance with the indication from the indicating means, the navigation apparatus preferably provides the child with positive feedback.

Additionally, or alternatively, when the child does not move the steering means in the first direction as indicated by the indicating means, he or she is preferably informed of the error.

Therefore, a (child) user of the present invention can be provided with feedback about his or her use of a movable toy steering means.

As a (toy) navigation apparatus according to the present invention does not rely on the limited resolution of a real Sat-Nav system, the user is able to use a (toy) navigation apparatus according to the present invention in a more confined space with the same sense of satisfaction and usability as he or she would find in a more open environment, such as a playing field.

Preferably, the alert means are further capable of, on the basis of the first information, alerting the user if, within a pre-determined period of time, the steering means is not moved by a predetermined amount in the first direction. Where the steering means is rotatable, the predetermined mount may be a predetermined angular amount, for example 10 degrees, 20 degrees, 30 degrees, 40 degrees, 45 degrees, 60 degrees or 90 degrees or more. Therefore, the indicator means may indicate to the user to move the steering means in a first direction by a predetermined amount, e.g. by such a predetermined angular amount.

Means may be included for communicating the first information from the first sensor, thereby permitting at least the alert means and the first sensor to be located remotely with respect to one another. The means may be wireless communication means such as a radio frequency transmitter/receiver. For example, the proprietary wireless communication system Bluetooth® may be used. Other means for wireless communication could be employed; for example, any light emitting means, such as a LED or a laser diode, for example, and photo detectors such as photodiodes. Optical fibres may be used to communicate the first information.

A controller unit may be provided, the controller unit being capable of controlling the indicating means to determine the indication provided to the user. The controller unit may be capable of communicating wirelessly with the indicating means. In this way a supervisor, for example a parent, can control the indication provided by the indicating means to the user, for example a child. Therefore, a passenger in a vehicle could, for example, replicate the instruction given by a real Sat-Nav system to the driver by controlling the indicating means to indicate to a (child) user in the back seat using a back seat steering wheel (as described above) to rotate the steering means, e.g. a steering wheel, in a suitable manner to mimic what the driver should do.

The steering means may be included in a movable toy, such as a movable toy vehicle in which the user may be able to sit. The indicating means may be capable of indicating to a user to move the toy by a first distance. The apparatus may include a second sensor for detecting a distance travelled by the toy and for outputting second information indicative of the detected distance travelled by the toy. The alert means may be capable of alerting the user on the basis of the second information when the judgement is that the distance travelled by the toy does not correspond to the indicated distance to travel, and/or the judgement is that the distance travelled by the toy corresponds to the indicated distance to travel.

Where the toy is a toy vehicle having one or more rotatable wheels, e.g. for moving the vehicle forward or backwards, the second sensor may be capable of detecting rotation of at least one of the one or more rotatable wheels, and may be capable of outputting the second information on the basis of the detected rotation.

The present invention may be used in conjunction with a toy which includes a movable gear stick, the indicating means may be capable of indicating the user to move the gear stick. A navigation apparatus in accordance with the present invention may further include a third sensor which may be capable of detecting movement of the gear stick and of outputting third information indicative of the detected motion of the gear stick. The alert means may be capable of alerting the user on the basis of the third information when the judgement is that the motion of the gear stick does not correspond to the indicated motion of the gear stick, and/or the judgement is that the motion of the gear stick corresponds to the indicated motion of the gear stick.

In a further aspect, the present invention aims to provide a method of fitting the navigation apparatus, e.g. as described above, for example, to a toy having a movable steering means, where the method includes the steps set forth hereafter.

Optional and/or preferred features of any one aspect of the invention may be applied to any one of the other aspects. In addition, any one or more aspects of the invention may be combined with any other aspect.

The present invention will now be disclosed by way of example only, with reference to the accompanying figures, in which:

FIG. 1 shows a "sit and ride" type vehicle incorporating a navigation apparatus according to the present invention;

FIG. 2 shows a toy having a movable steering means, and a navigation apparatus according to the present invention;

Figure 4:
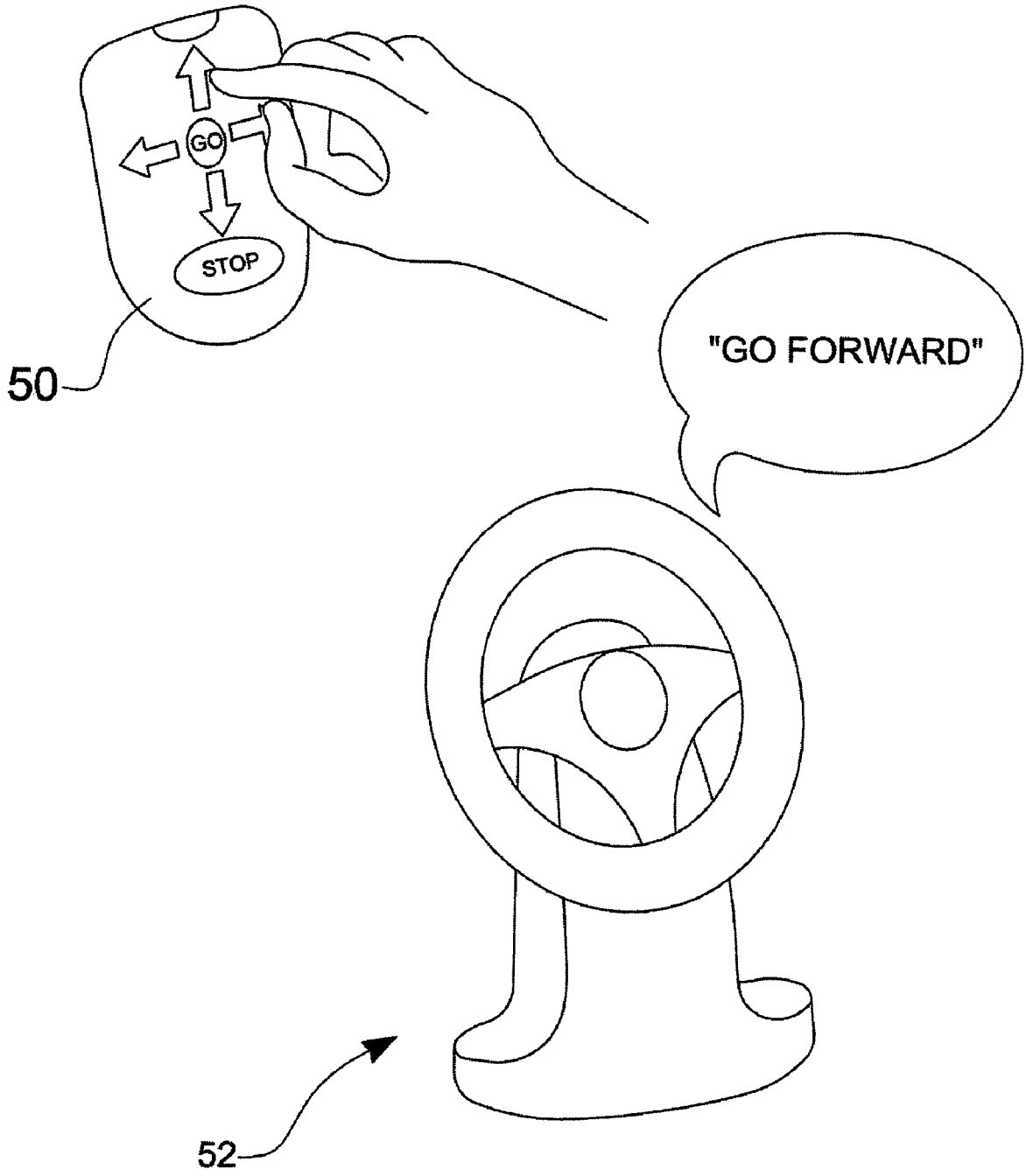
Figure 5:
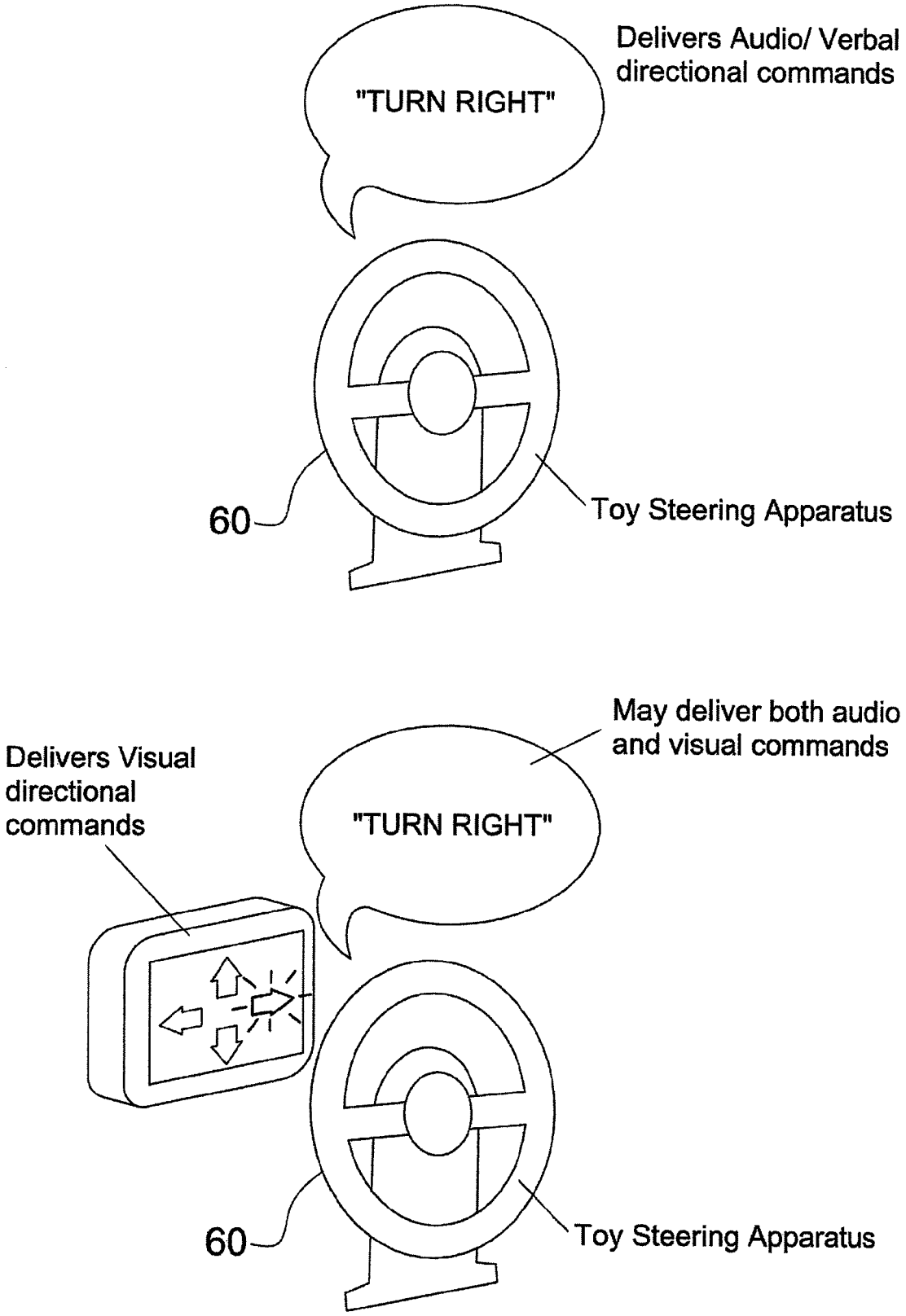

FIG. 3*a* shows another embodiment of the present invention in which the indicating means is shown as a separate unit to the movable steering means;

FIG. 3*b* shows an embodiment of the present invention in which the indicating means is formed integrally with the toy including a moving steering means;

FIG. 4 shows an embodiment of the present invention including a remote control unit for controlling the indicating means according to the present invention;

FIG. 5 shows alternative embodiments of the present invention; and

Figure 6:
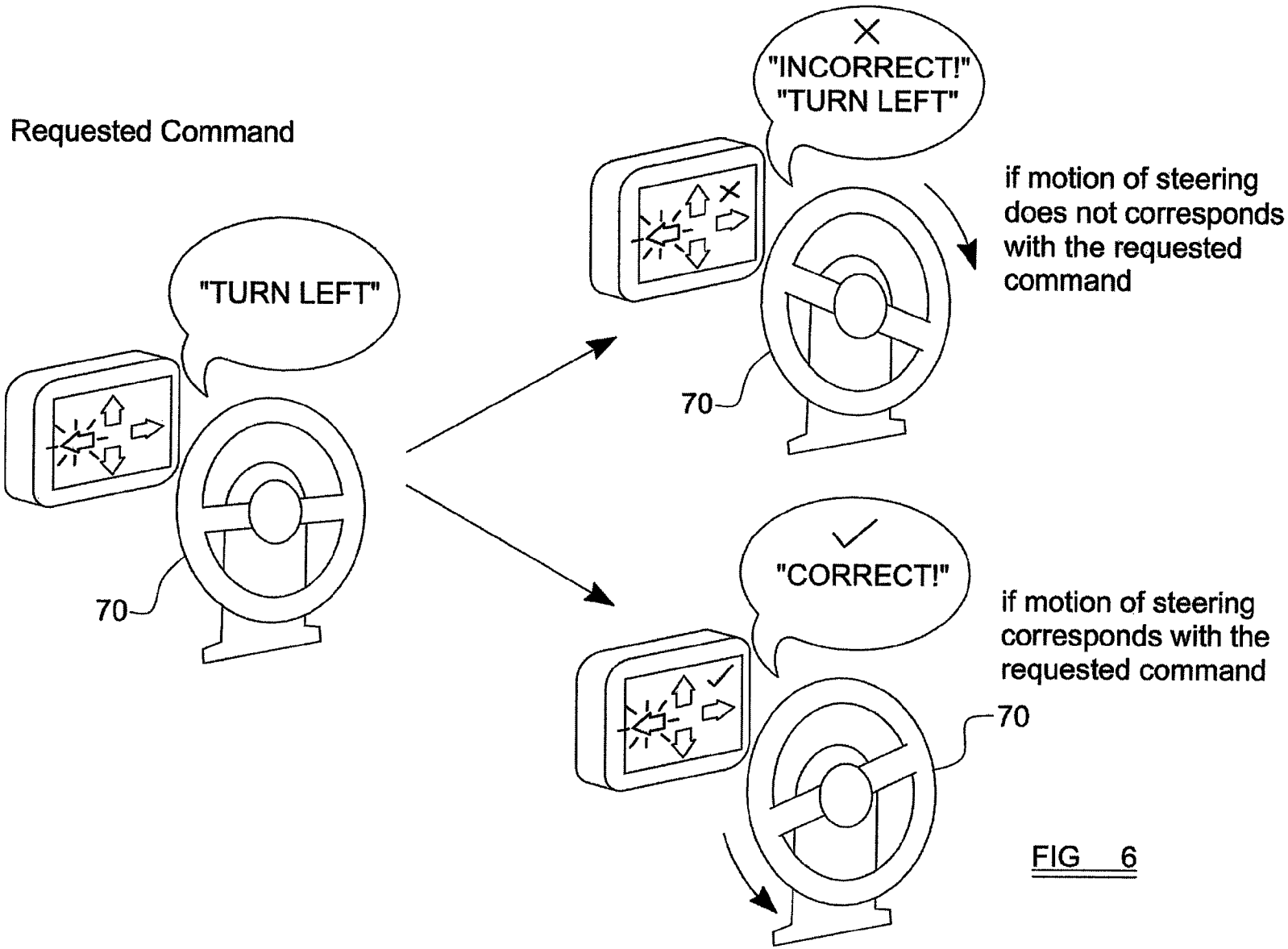

FIG. 6 shows a preferred embodiment of the present invention.

In FIG. 1, the user, such as a child, is sat in or on a sit and ride vehicle 10, the vehicle 10 is able to be moved forward and perhaps back by the user. Vehicle 10 may be pedal powered, battery powered or it may even be powered by an internal combustion engine, for example.

The vehicle 10 includes a navigation apparatus (12) in accordance with the present invention. The apparatus includes indicating means for indicating to the user to turn the steering wheel 14 to move the vehicle in a specific direction, e.g. left or right. The apparatus 12 includes a sensor (not shown) for detecting whether the user directs the vehicle 10 in such a manner. For example, the sensor may sense a rotation of the steering wheel 14. Alternatively, the sensor may sense a movement of a movable axle coupling the steering wheel 14 to any one or more of the front and/or rear wheels 16. The sensor communicates information indicative of the sensed movement to an alert means, included in the apparatus 12. The alert means alerts the user that he or she has complied with the indication given by the navigation apparatus, and/or it may inform the user that he or she has not complied with the indication.

A further sensor, or the same sensor, may be provided to determine whether the vehicle 10 is moved a particular distance in response to an indication to do so by the navigation apparatus 12. This information is communicated from such a sensor to the alert means. The alert means may alert the user that he or she has moved the vehicle in accordance with the indication and/or it may alert the user that the vehicle has not been moved by the user in accordance with the indication.

The sensor for sensing the distance travelled may be configured to sense the extent of rotation of one or more of the wheels by which the toy is movable. On the basis of this extent of rotation (i.e. the total angular rotation of the one or more wheels, which may exceed 360 degrees) and on the basis of the known radius, diameter and/or circumference of the or each wheel, the total distance travelled is calculable by a calculating means, such as a microprocessor. The alert means being configured to provide the or each alert concerning the distance travelled on the basis of this calculation.

The vehicle may include a gear stick (not shown) for changing the gear through which the drivable wheels of the vehicle 10 are driven. Yet another sensor, or the same sensor as either or both of the previously described sensors, may be provided to detect movement of the gear stick in response to an indication to do so by the navigation apparatus. Such a sensor may communicate information relating to the movement of the gear stick to the alert means. The alert means may be configured to alert the user that he or she has moved the gear stick in accordance with the indication to do so, and/or it may be configured to alert the user that he or she has not moved the gear stick in accordance with the indication to do so.

The present invention is also useable with a toy of the type shown in FIG. 2. Such a toy is similar to the "Backseat Driver" and "Electronic Backseat Driver" toys sold by the present applicant, and the present invention is useable with such toys. A toy of the type shown in FIG. 2 may be mountable in the back of a vehicle, for example to the back of the driver's seat or the passenger's seat so as to be used by a user e.g. a child located in the back of the vehicle. The toy may even be couplable to an internal portion of a back door of the vehicle, or even to the window of such a door, e.g. by a sucker (not shown).

The toy has a movable steering means, e.g. a steering wheel 20, it may have a movable gear stick 22, it may have a movable indicating stick 24. According to the present invention, a navigation apparatus for use with such a toy includes an indicating means 25 for indicating to the user to move the steering wheel 20 in a particular direction. For example, the indication may tell the user to turn left, to turn right, to rotate left or to rotate right. A sensor (not shown) is also included, the sensor being capable of sensing that the steering wheel 20 is moved in response to the indication to do so. The sensor communicates this information to an alert means, which in turn alerts the user that he or she has and/or has not moved the steering wheel 20 in accordance with the indication to do so.

The indication means may be configured to indicate to the user to move the gear stick 22. A further sensor, or the same sensor, may be provided to sense movement of the gear stick, and to convey information indicative of the movement of the gear stick to the alert means. The alert means may be configured to alert the user that he or she has and/or has not moved the gear stick in accordance with the indication to do so.

The indication means may be configured to indicate to the user to move the indicator stick 24 in a first direction, and yet another sensor, or the same sensor as either or both of the previously described sensors, may be provided to sense movement of the indicator stick and to convey information indicative of the movement of the indicator stick to the alert means. The alert means may be configured to alert the user that he or she has and/or has not moved the indicator stick 24 in accordance with the indication to do so.

FIG. 3*a* shows an example of a toy steering wheel which may have had a navigational apparatus according to the present invention retro fitted to it. A sensor is fitted to detect movement of the steering wheel 30, and information indicative of movement of the steering wheel is conveyed to a combined indicated means and alert means 32.

FIG. 3*b* shows a similar toy in which the indicating means 34, alert means and sensor are formed integrally with the toy 36, and which, for example, may have been originally provided together with the toy, rather than being retrofitted to it.

In FIG. 4, a remote control unit 50 is shown. The remote control unit 50 may be usable by a supervisor, e.g. a parent, to control the indicating means included in the toy 52. The remote control unit 50 may be provided with e.g. buttons for controlling the indicating means to issue an indication to turn left, to turn right, to go straight on, to reverse and/or simply to go, to stop, to change gear, to use the indicator stick, and/or to travel for a set distance, for example. The remote control unit 50 may communicate with the indicating means included in the toy 52 wirelessly, for example by a radio frequency transmitter, a transmitter employing the "Bluetooth"® system, by LED or laser diode etc.

Therefore, the remote control unit 50 gives a supervisor, for example a parent, the ability to control the indications given to a child being instructed by the indicating means. This is particularly advantageous when used in conjunction with the embodiment shown e.g. in FIG. 1, where the supervisor can control the path which is to be indicated to the (child) user and the length of the path to be taken by the (child) user using such a vehicle.

Also, in relation to e.g. the toy shown in FIG. 2, a parent who is a passenger in a vehicle being driven by a driver instructed by a real Sat-Nav system can give corresponding instructions to the child using the toy. Where a child wishes to mimic the driver, this will give pleasure, because the driver will be instructed by the real Sat-Nav system to turn right, for example, and the passenger supervisor (e.g. a parent) using the remote control unit 50 can give a corresponding instruction to the child via the indicating means. Whilst the driver can perceive for himself/herself that he/she has followed the instructions from the real Sat-Nav correctly, according to the present invention the child can also perceive that he or she is following the indications from the indicating means correctly by virtue of the alert means.

A navigation apparatus according to the present invention may include a voice recognition module (not shown). The voice recognition module may be configured to control the indication provided by the indicating means to the user of the navigation apparatus on the basis of a recognised instruction. The voice recognition module may be configured to control the indicating means in response to an audible instruction e.g. from a real Sat-Nav apparatus and/or from a supervisor of the (child) user of the navigation apparatus. Accordingly, the voice recognition module may be provided in the remote control unit 50. The voice recognition module may be provided together with the indicating means.

In FIG. 5, it is demonstrated that the indicating means may give an audible indication to move e.g. a steering wheel 60 in a particular direction. Some of the audible commands may be given e.g. to indicate to the user to move a toy vehicle by a predetermined distance, at a predetermined speed, in a predetermined gear, etc. Where the indicating means is so configured to provide audible indications to a user, the voice recognition module is preferably configured to be non-responsive to such audible indications.

Additionally or alternatively, as also shown in FIG. 5 the indicating means may give a visual indication e.g. of a direction in which to move e.g. a steering wheel.

In FIG. 6 it is shown that alert means may be provided to indicate to the user that they have not moved e.g. a steering wheel 70 in accordance with the indication given by the indication means. For example, a visual and/or audible alert may be given to the user that they have turned the steering wheel in a wrong direction, or have not turned the steering wheel far enough, for example.

Additionally, or alternatively, the alert means may indicate to the user that they have moved the steering wheel, for example, in the correct direction and preferably by the correct amount.

The indicating means and the alert means may be included in a single unit e.g. as shown in FIG. 6.

The indicating means and/or alert means may include tactile feedback means, which indicates and/or alerts the user by the sense of touch. For example, a steering means may vibrate when the user does not follow the indication from the indicating means. Additionally, or alternatively, at least a portion of the steering means, e.g. one side of a steering wheel, may provide a tactile indication to the user to move the steering means in a particular direction. For example, the left side, e.g. left semi-circle of a steering wheel, may vibrate to indicate to the user to turn the steering wheel left.

In another embodiment, a remote controlled vehicle, e.g. a radio controlled vehicle, such as a car, includes a navigation apparatus according to the present invention. The steering means may be the means for controlling the direction of movement of the remote control vehicle, for example the joystick or steering wheel held by a user. Consequently, the or each sensor may be included in the user held control device. However, the steering means may be the wheels or axle, for example, on the remote control vehicle, which govern the direction of movement of the vehicle. Consequently, the or each sensor may be provided in the vehicle itself. Preferably, the or each sensor is included in the vehicle. A sensor may be included to sense the distance traveled by the vehicle. A sensor may be included to sense movement of a gear stick for controlling the gear through which the vehicle is driven.

The indicating means is preferably located in the remote control unit. The alert means is preferably provided in the remote control unit. However, either or both of these means may be located in the remotely controlled vehicle. In a preferred embodiment, the indicating means and/or the alert means preferably include means for audibly indicating to and/or alerting the user. The indicating means and/or the alert means may include means for visually indicating to and/or alerting the user.

The present invention may also be used in conjunction with e.g. a bicycle (the term bicycle also being intended to cover, for example, a tricycle, a quad-bike, a tandem etc.). The sensor may sense movement of the handlebars, e.g. relative to the bicycle frame, and convey information indicative of this movement to the alert means. The alert means may be configured to alert the user that he or she has or has not moved the handlebars in accordance with the indication provided by indicating means.

A navigation apparatus according to the present invention may be fitted to an existing toy. A method of doing this may include the steps of: arranging, relative to a toy including steering means, e.g. a steering wheel, the indicating means to be capable of indicating to a user of the toy to move the steering means; arranging a sensor to be capable of sensing such movement and to be capable of communicating information indicative of such movement to an alert means; and arranging alert means to be capable of alerting the user that he or she has and/or has not moved the steering means as indicated.

Where the toy includes a moveable gear stick, the method may also include the step of arranging the indicating means to be capable of indicating to the user of the toy to move the gear stick, and of arranging the sensor, or a further sensor, to be capable of sensing movement of the gear stick and to be capable of conveying information indicative of such movement to the alert means, and of arranging the alert means to be capable of alerting the user that he or she has and/or has not moved the gear stick as indicated.

Where the toy includes one or more rotatable wheels for moving the vehicle across a surface, the method may also include the step of arranging the indicating means to be capable of indicating to the user of the toy to move the toy on its wheels a first distance, and of arranging the sensor, or a further sensor, to be capable of sensing the distance travelled to be capable of conveying information indicative of such a distance travelled to the alert means, and of arranging the alert means to be capable of alerting the user that he or she has and/or has not moved the toy by the indicated first distance.

A kit of parts may be provided for being retrofitted to a suitable toy. The kit of parts may include an alert means as described herein, an indicating means as described herein and one or more sensors as described herein. The kit of parts may be supplied with instructions for fitting one or more of the components of the kit of parts to a toy having at least a movable steering means, e.g. a steering wheel, but may also include instructions for fitting one or more components of the kit of parts to a toy having a movable gear stick and/or a movable indicating stick and/or movable wheels for moving the vehicle e.g. along the ground. The instructions may indicate to the user how to arrange relative to a toy the or each sensor described herein to sense movement of the steering means, e.g. the steering wheel, and/or movement of a gear stick (if present) and/or movement of an indicating stick (if present) and/or to sense a distance travelled by the toy.

A navigation apparatus according to the present invention may include a judgement means, said judgement means being configured to judge, on the basis of information provided by the or each sensor, whether the user has complied with the or each indication provided by the indicating means. The alert means may be configured to alert the user appropriately on the basis of a judgement of the judgement means.

The foregoing description of the preferred embodiments of the invention have been presented for purposes of illustration and description, it is not intended to be exhaustive or to limit the invention to the precise form disclosed, and modifications and variations are possible in light of the above teachings.

It is intended that the scope of the invention be defined by the claims appended hereto.

The following statements provide general expressions of the disclosure herein:

A. A navigation apparatus for use with a toy having a movable steering means, the apparatus including:

indicating means for indicating to a user to move the steering means in a first direction;

a first sensor capable of detecting a movement of the steering means and of outputting first information indicative of the detected direction of motion of the steering means; and alert means for alerting the user on the basis of the first information when (i) the direction of motion of the steering means does not correspond to the indicated direction of motion, and/or (ii) the direction of motion of the steering means corresponds to the indicated direction of motion.

B. A navigation apparatus according to statement A, the alert means further being capable of, on the basis of the first information, alerting the user if, within a predetermined period of time, the steering means is not moved by a predetermined amount in the first direction.

C. A navigation apparatus according to statement A or B, further including means for wirelessly communicating the first information from the first sensor.

D. A navigation apparatus according to statement C wherein the means for wireless communication includes an electromagnetic transmitter in communication with said first sensor for transmitting said first information to an electromagnetic receiver in communication with said alert means.

E. A navigation apparatus according to any one of the preceding statements further including a controller unit, the controller unit being capable of controlling the indicating means to determine the indication provided to the user.

F. A navigation apparatus according to statement E, wherein the controller unit is capable of communicating wirelessly with the indicating means.

G. A navigation apparatus according to statement E or F, wherein the controller unit is manually operable by a supervisor to control the indicating means.

H. A navigation apparatus according to any of the preceding statements, wherein the steering means is rotatable, the indicating means being capable of indicating to a user to rotate the steering means in a first direction, the first sensor being capable of detecting a rotation of the steering means and of outputting the first information to be indicative of the detected direction of rotation of the steering means, and the alert means being capable of alerting the user on the basis of the first information when (i) the direction of rotation of the steering means does not correspond to the indicated direction of rotation, and/or (ii) the direction of rotation of the steering means corresponds to the indicated direction of rotation.

I. A navigation apparatus according to any one of the preceding statements wherein the steering means includes a steering wheel.

J. A navigation apparatus according to any one of the preceding statements wherein the steering means includes a set of handlebars.

K. A navigation apparatus according to any one of the preceding statements, wherein the indicating means is capable of indicating to a user to move the toy by a first distance;

the apparatus includes a second sensor for detecting a distance travelled by the toy and for outputting second information indicative of the detected distance travelled by the toy; and wherein the alert means is capable of alerting the user on the basis of the second information when (i) the judgement is that the distance travelled by the toy does not correspond to the indicated distance to travel, and/or (ii) the judgement is that the distance travelled by the toy corresponds to the indicated distance to travel.

L. A navigation apparatus according to statement K, wherein the toy is a toy vehicle having one or more rotatable wheels, the second sensor being capable of detecting rotation of at least one of the one or more rotatable wheels, and of outputting the second information on the basis of the detected rotation.

M. A navigation apparatus according to any one of the preceding statements, wherein the toy further includes a movable gear stick, and the indicating means is capable of indicating to a user to move the gear stick;

the apparatus further including a third sensor capable of detecting movement of the gear stick and of outputting third information indicative of the detected motion of the gear stick; and wherein the alert means is capable of alerting the user on the basis of the third information when (i) the judgement is that the motion of the gear stick does not correspond to the indicated motion of the gear stick, and/or (ii) the judgement is that the motion of the gear stick corresponds to the indicated motion of the gear stick.

N. A toy vehicle having steering means capable of altering the direction of motion of the toy vehicle, the toy vehicle including a navigation apparatus according to any one of statements A to L.

O. A toy vehicle according to statement N further including a gear stick for changing a driving gear of the toy vehicle, the toy vehicle including a navigation apparatus according to statement M.

P. A toy vehicle according to statement N or O which is pedal powered.

Q. A toy vehicle according to statement N or O which is battery powered.

R. A toy vehicle according to statement N or O which includes an internal combustion engine.

S. A toy having a rotatable steering means, the toy including a navigation apparatus according to any one of statements A to L.

T. A toy according to statement S further including a movable gear stick, the toy including a navigation apparatus according to statement M.

U. A kit of parts comprising:

(i) an indicating means according to any of statements A to M;

(ii) a first sensor according to any one of statements A to M; and (iii) an alert means according to any one of statements A to M;

V. A kit of parts according to statement U further comprising a second sensor according to statements K or L, wherein the alert means is an alert means according to any one of statements K to M.

W. A kit of parts according to statements U or V further comprising a third sensor according to statement M, wherein the alert means is an alert means according to statement M.

X. A method of fitting a navigation apparatus according to any one of statements A to M to a toy having a movable steering means, the method including the steps of:

arranging indicating means to be capable of indicating to a user to move the steering means in a first direction;

arranging a first sensor to be capable of detecting a movement of the steering means and of outputting first information indicative of the detected direction of motion of the steering means; and arranging alert means to be capable of alerting the user on the basis of the first information when (a) the direction of motion of the steering means does not correspond to the indicated direction of motion, and/or (b) the direction of motion of the steering means corresponds to the indicated direction of motion.

Y. A method according to statement X, further including the steps of arranging the indicating means to be capable of indicating to a user to move the toy by a first distance arranging a second sensor to be capable of detecting a distance travelled by the toy and of outputting second information indicative of the detected distance travelled by the toy; and arranging the alert means to be capable of alerting the user on the basis of the second information when (a) the judgement is that the distance travelled by the toy does not correspond to the indicated distance to travel, and/or (b) the judgement is that the distance travelled by the toy corresponds to the indicated distance to travel.

Z. A method according to statement X or Y, wherein the toy further includes a movable gear stick, the method further including the steps of:

arranging the indicating means to be capable of indicating to a user to move the gear stick arranging a third sensor to be capable of detecting movement of the gear stick and of outputting third information indicative of the detected motion of the gear stick; and arranging the alert means to be capable of alerting the user on the basis of the third information when (a) the judgement is that the motion of the gear stick does not correspond to the indicated motion of the gear stick, and/or (b) the judgement is that the motion of the gear stick corresponds to the indicated motion of the gear stick.

ZA. A method according to any one of statements X to Z wherein the toy has a rotatable steering means, the method including the steps of:

arranging the indicating means to be capable of indicating to a user to rotate the steering means in a first direction;

arranging the first sensor to be capable of detecting a rotation of the steering means and of outputting the first information to be indicative of the detected direction of rotation of the steering means; and arranging the alert means to be capable of alerting the user on the basis of the first information when (a) the direction of rotation of the steering means does not correspond to the indicated direction of rotation, and/or (b) the direction of rotation of the steering means corresponds to the indicated direction of rotation.

ZB. A navigation apparatus substantially as described herein, with reference to, and as illustrated in the accompanying figures.

ZC. A toy vehicle substantially as described herein, with reference to, and as illustrated in the accompanying figures.

ZD. A toy substantially as described herein, with reference to, and as illustrated in the accompanying figures.

The invention claimed is:

1. A navigation apparatus for use with a toy having a movable steering means, the navigation apparatus including:

an indicating means for indicating to a user a desired motion of the steering means of the toy in a first direction;

a first sensor operatively connected to the steering means of the toy which detects a direction of motion of the steering means by the user and which outputs first information indicative of the detected direction of motion of the steering means; and alert means for receiving the first information outputted by the first sensor and for generating an alert to the user on the basis of the first information when (i) the detected direction of motion of the steering means does not correspond to the indicated direction of motion, and/or (ii) the direction of motion of the steering means corresponds to the indicated direction of motion.

2. A navigation apparatus according to claim 1, the alert means further being capable of, on the basis of the first information, alerting the user if the steering means is not moved by a predetermined amount in the first direction within a predetermined period of time.

3. A navigation apparatus according to claim 1, further including means for wirelessly communicating the first information from the first sensor.

4. A navigation apparatus according to claim 3 wherein the means for wireless communication includes an electromagnetic transmitter in communication with said first sensor for transmitting said first information to an electromagnetic receiver in communication with said alert means.

5. A navigation apparatus according to claim 1 further including a controller unit, the controller unit being capable of controlling the indicating means to determine the indication provided to the user.

6. A navigation apparatus according to claim 5, wherein the controller unit is capable of communicating wirelessly with the indicating means.

7. A navigation apparatus according to claim 5, wherein the controller unit is manually operable by a supervisor to control the indicating means.

8. A navigation apparatus according to claim 1, wherein the steering means is rotatable, the indicating means being capable of indicating to a user to rotate the steering means in a first direction, the first sensor being capable of detecting a rotation of the steering means and of outputting the first information to be indicative of the detected direction of rotation of the steering means, and the alert means being capable of alerting the user on the basis of the first information when (i) the direction of rotation of the steering means does not correspond to the indicated direction of rotation, and/or (ii) the direction of rotation of the steering means corresponds to the indicated direction of rotation.

9. A navigation apparatus according to claim 1 wherein the steering means includes a steering wheel.

10. A navigation apparatus according to claim 1, wherein the indicating means is capable of indicating to a user to move the toy by a first distance;

the apparatus includes a second sensor for detecting a distance traveled by the toy and for outputting second information indicative of the detected distance traveled by the toy; and wherein the alert means is capable of alerting the user on the basis of the second information, and the alert means includes a judgment means (i) for judging that the distance traveled by the toy does not correspond to the indicated distance to travel, and/or (ii) for judging that the distance traveled by the toy corresponds to the indicated distance to travel.

11. A navigation apparatus according to claim 10, wherein the toy is a toy vehicle having one or more rotatable wheels, the second sensor being capable of detecting rotation of at least one of the one or more rotatable wheels, and of outputting the second information on the basis of the detected rotation.

12. A navigation apparatus according to claim 1, wherein the toy further includes a movable gear stick, and the indicating means is capable of indicating to a user to move the gear stick;

the apparatus further including a third sensor capable of detecting movement of the gear stick and of outputting third information indicative of the detected motion of the gear stick; and wherein the alert means is capable of alerting the user on the basis of the third information, and the alert means includes a judgment means (i) for judging that the motion of the gear stick does not correspond to the indicated motion of the gear stick, and/or (ii) for judging that the motion of the gear stick corresponds to the indicated motion of the gear stick.

13. A toy vehicle including a navigation apparatus according to claim 1 and having steering means capable of altering the direction of motion of the toy vehicle.

14. A toy including a navigation apparatus according to claim 1 and having a rotatable steering means.

15. A toy according to claim 14 further including a movable gear stick, wherein the indicating means is capable of indicating to a user to move the gear stick;

the apparatus further includes a third sensor capable of detecting movement of the gear stick and of outputting third information indicative of the detected motion of the gear stick; and the alert means is capable of alerting the user on the basis of the third information, and the alert means includes a judgment means (i) for judging that the motion of the gear stick does not correspond to the indicated motion of the gear stick, and/or (ii) for judging that the motion of the gear stick corresponds to the indicated motion of the gear stick.

16. A kit of parts for forming a navigation apparatus for use with a toy having a movable steering means, the kit of parts comprising:

an indicating means for indicating to a user a desired motion of the steering means of the toy in a first direction;

a first sensor operatively connectable to the steering means of the toy which detects a direction of motion of the steering means by the user and which outputs first information indicative of the detected direction of motion of the steering means; and an alert means for receiving the first information outputted by the first sensor and for generating an alert to the user on the basis of the first information when (i) the detected direction of motion of the steering means does not correspond to the indicated direction of motion, and/or (ii) the direction of motion of the steering means corresponds to the indicated direction of motion.

17. A kit of parts according to claim 16 further comprising a second sensor for detecting a distance traveled by the toy and for outputting second information indicative of the detected distance traveled by the toy;

wherein the alert means is capable of alerting the user on the basis of the second information, and the alert means includes a judgment means (i) for judging that the distance traveled by the toy does not correspond to the indicated distance to travel, and/or (ii) for judging that the distance traveled by the toy corresponds to the indicated distance to travel.

18. A kit of parts according to claim 16 further comprising a third sensor capable of detecting movement of the gear stick and of outputting third information indicative of the detected motion of the gear stick; and wherein the alert means is capable of alerting the user on the basis of the third information, and the alert means includes a judgment means (i) for judging that the motion of the gear stick does not correspond to the indicated motion of the gear stick, and/or (ii) for judging that the motion of the gear stick corresponds to the indicated motion of the gear stick.

* * * * *